United States Patent [19]

Carlson

[11] Patent Number: 4,611,417

[45] Date of Patent: Sep. 16, 1986

[54] NON-ROTATABLE TOOTH FOR A CYLINDRICAL SOCKET BORE

[76] Inventor: John H. Carlson, Rte. 2, Box 400, Odessa, Tex. 79764

[21] Appl. No.: 586,439

[22] Filed: Mar. 5, 1984

[51] Int. Cl.[4] ..... E02F 9/28

[52] U.S. Cl. ..... 37/141 T; 37/142 A; 299/91

[58] Field of Search ..... 299/86, 91–93; 37/141 R, 141 T, 142 R, 142 A

[56] References Cited

U.S. PATENT DOCUMENTS

| | | | |
|---|---|---|---|
| 1,210,366 | 12/1916 | Reisinger | 37/142 R |
| 1,890,997 | 12/1932 | Lane | 37/142 R |
| 2,229,267 | 1/1941 | Younie | 37/142 |
| 2,263,215 | 11/1941 | Larsen | 37/142 R |
| 3,203,488 | 8/1965 | Eastwood, III | 37/142 R X |
| 3,357,117 | 12/1967 | Petersen | 37/142 A |
| 3,629,964 | 12/1971 | Russel | 37/141 T |
| 3,737,199 | 6/1973 | Stephenson | 299/89 |
| 3,778,112 | 12/1973 | Krekeler | 299/86 |
| 3,841,709 | 10/1974 | Kniff | 299/88 |
| 3,856,359 | 12/1974 | Krekeler | 37/142 A X |
| 3,992,061 | 11/1976 | Rollins | 299/86 |

*Primary Examiner*—Clifford D. Crowder

*Attorney, Agent, or Firm*—Marcus L. Bates

[57] ABSTRACT

A non-rotatable excavating tooth has a forward ground engaging portion, a rearward shank portion which is cylindrical in cross-section, and a shield assembly. The shank has a keeper removably positioned thereon for releasably capturing the shank of the digging tooth within a tooth receiving pocket. The tooth receiving pocket preferably is welded to a bucket lip of a digging or trencher machine. The shield includes two opposed sidewalls which abuttingly engage the opposed sidewalls of the pocket, thereby rendering the tooth non-rotatable respective to the pocket. The non-rotatable digging tooth is interchangeable with and can be substituted for a rotatable type rock bit without any modification of the pocket.

13 Claims, 5 Drawing Figures

NON-ROTATABLE TOOTH FOR A CYLINDRICAL SOCKET BORE

BACKGROUND OF THE INVENTION

Trenching machines of the type having a multiplicity of buckets circumferentially arranged about a digging wheel often employ rotatable rock type bits, wherein the rotatable bits are removably received within a pocket made especially therefor. The pocket usually is welded to the bucket lip. The rock bit is made for digging in hard, rocky formations and for this reason, it is rotatably received within the bore of the pocket, so that as the formation is engaged by the forward end of the bit, the bit rotates within the pocket, thereby promoting even wear about the wear surfaces thereof.

From time to time, the formation encountered by the trencher will change from rock to soil or clay, and when this change in the formation characteristics occur, it is advantageous to employ a non-rotatable, blade-like digging tooth in lieu of the rotatable rock bit. The pocket for the rock bit is usually quite different from the pocket required for the blade-like tooth, and it is therefore unfeasible under ordinary circumstances to change the pockets on the bucket lip so that the pocket will receive an ordinary blade type digging tooth.

College, et al U.S. Pat. Nos. 4,346,934; Taylor, et al 4,316,636; and Swisher, Jr., et al 4,335,921 set forth means for rendering digging teeth non-rotatable respective to the tooth receiving pocket thereof.

Swisher, Jr., et al, in FIGS. 1 and 2, forms a support block shoulder 54 which engages a shoulder 74 formed on the rear end of the tooth shank. FIGS. 4 and 5 thereof illustrate a yoke 140 secured within a channel 138. Other figures of the Swisher, Jr., et al drawings illustrate a yoke which mates with a support block shoulder formed on a face of the support block.

Taylor, et al discloses a bit shank of non-circular configuration received within a complementary bore of the support block, while College, et al discloses a digging tooth having a shank 24 received within a bit block 36. A tang 38 extends into abutting contact with a face of the bit block and prevents rotation of the digging tooth respective to the bit block.

When excavating relatively soft formation, the digging teeth of Swisher, Jr., et al and Taylor, et al cause the excavated material to wear against critical areas of the bit block or pocket and ultimately the bit pocket is eroded away and either must be rebuilt or replaced. This is an expensive endeavor and necessitates substitution of a new block for the old, which naturally requires that the old block be cut off with an oxy-acetylene cutting torch and then the resultant irregular surface must be dressed down by grinding or the like, so that the new block can be welded in its place. Alternatively, the old block must be build up with welding, which results in the continued use of a pocket having considerable wear in the bore thereof. In both Swisher, Jr., et al and Taylor, et al, the bore formed in the bit block has been modified considerably. The Taylor, et al block will no longer accept a circular shank of a rock type tooth.

College, et al relies upon the tang 38 extending down the forward face of the bit block in order to prevent tooth rotation, and accordingly, when a rotational force is effected on the bit, the tang 38, if rotated respective to the block, presents a mechanical advantage which thrusts the shank 24 in an outward direction respective to the block bore.

It would therefore be desirable to have made available an improved digging tooth having a shank which is circular in crosssection and is easily mounted within a rock bit type pocket; and wherein a digging tooth of the type which efficiently digs in a soft formation can be non-rotatably mounted therein by the provision of a rearwardly directed shield having opposed wall surfaces formed thereon for engaging opposed wall surfaces of the bit receiving pocket. The advantages of this novel construction are the presentation of a digging tooth which can be used in conjunction with a rock bit type pocket, wherein each tooth is rendered nonrotatable by capturing the outer sidewalls of the rock bit pocket within a cavity formed by the inner walls of the shield. The improved dirt digging tooth protects the bit pocket from wear; and, during the digging operation, the tooth shank is forced more securely into the bore of the pocket.

Throughout this disclosure, the term "bit" is intended to denote a rotatable type digging implement such as a rock type bit, while the term "tooth" or "teeth" denotes a non-rotatable type digging implement. The invention described herein is for use on trenchers having a plurality of buckets mounted to a circular wheel, as well as the endless chain type trenchers, and further includes buckets such as may be found on hydraulic excavators.

SUMMARY OF THE INVENTION

An improved digging tooth for use on a trencher is provided which enables a dirt type digging tooth to be directly substituted or interchanged for a rotatable rock type bit without the necessity of modifying the prior art bit receiving pocket. More specifically, the novel dirt type tooth has a shield formed at a medial portion thereof, wherein the shield has a cavity formed therewith, with the cavity having opposed interior sidewalls which are brought to bear against the opposed outer sidewalls of the tooth receiving pocket, so that the shield sidewalls abuttingly engage the pocket sidewalls whenever a rotational force is exerted into the digging tooth. The forward marginal length of the new tooth is made into a configuration suitable for engaging soft geological formations. The rear marginal length of the improved tooth is circular in cross-section and coincides with the configuration of a shank found on a prior art rock bit.

The shield provided on the improved tooth of the present invention provides a means for greatly reducing wear normally effected onto the external surface of the pocket. The improved tooth disclosed herein can be readily substituted for rock type bits without effecting any modification thereof.

Accordingly, a primary object of the present invention is the provision of a non-rotatable dirt type digging tooth which can be readily substituted for a rotatable rock type bit.

Another object of the invention is the provision of a shield formed on a digging tooth which captures the tooth respective to a tooth receiving pocket and renders the digging tooth nonrotatable respective to the pocket.

A further object of this invention is the provision of a digging tooth having a dirt type cutter blade formed at the forward end thereof, a rock type shank formed at the rear end thereof, and a shield formed at a medial portion thereof for enclosing a portion of a tooth receiving pocket and preventing relative rotation between the tooth and pocket.

Another and still further object of this invention is the provision of a novel combination of a tooth and pocket, wherein the tooth is a dirt type digging tooth having means incorporated thereon for rendering the tooth non-rotatable respective to a rock type bit receiving pocket.

An additional object of the invention is the provision of a method of directly substituting a dirt type tooth for a rock bit without modification of the bit block.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
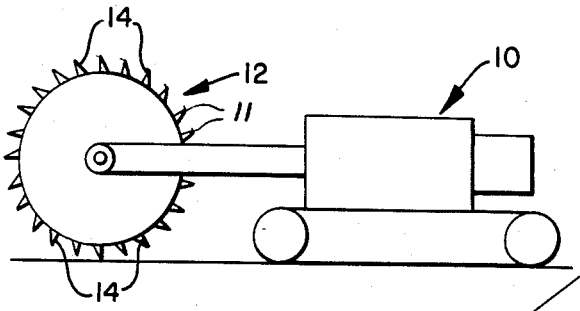
FIG. 1 is a diagrammatical representation of a trenching machine for digging ditches.

FIG. 1 of the drawings illustrates a trenching machine 10, such as a Buckeye 48 Trencher, for example. The trenching machine includes the usual rotating digging wheel assembly 12 having a plurality of digging buckets 14 circumferentially mounted in spaced relationship about the outer periphery thereof, as is known to those skilled in the art. Each bucket has a forwardly located bucket lip to which there is attached a plurality of digging teeth, wherein each tooth is received within a tooth receiving pocket. Numeral 11 of FIG. 1 schematically indicates the combination tooth and pocket therefor.

Figure 2:
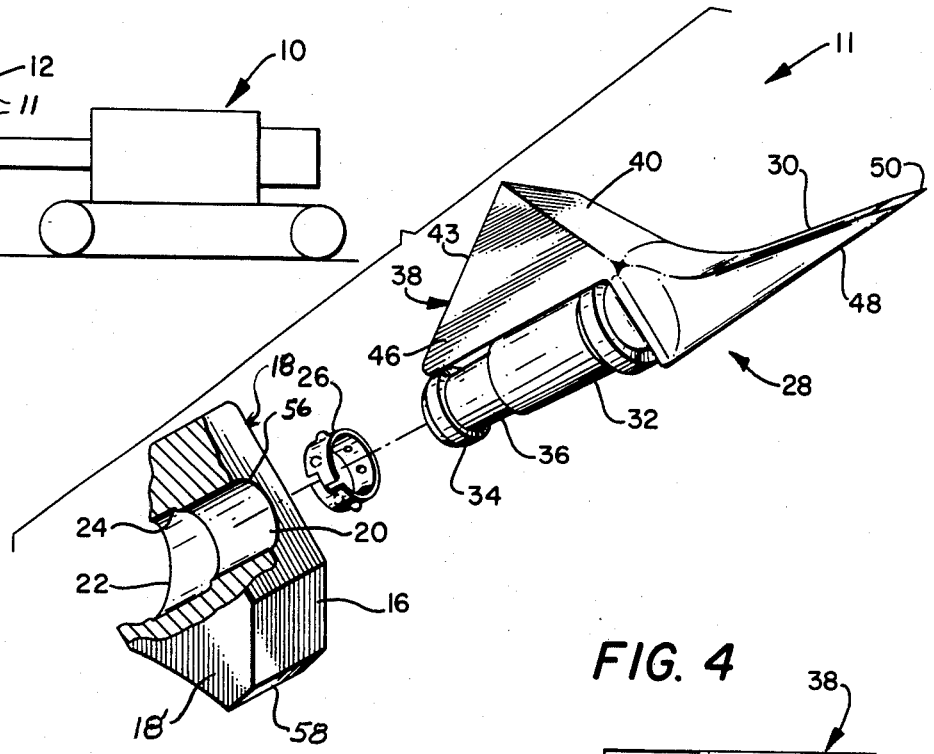
FIG. 2 is an enlarged, perspective, disassembled, part cross-sectional view of a digging tooth and pocket for use in the trencher of FIG. 1.

In FIG. 2, numeral 11 more specifically indicates the combination digging tooth and pocket. The pocket 16 can be welded to the lip of a bucket 14 associated with the trencher machine 10 of FIG. 1. The pocket includes spaced opposed sidewalls 18 and 18', and is provided with a bore 20 which extends longitudinally through the pocket for rotatably receiving the cylindrical shank of a prior art rock bit therewithin. The bore 20 increases in diameter at 22, with there being a shoulder 24 formed therebetween.

In this disclosure, a "rock type bit" is intended to denote a rotatable bit having a cylindrical shank which is received within the cylindrical bore of a bit receiving pocket in a manner whereby the digging action imparts rotational movement into the bit whereby a new surface of the bit is continuously brought to bear against a rock-like formation. The term "dirt tooth" or "digging tooth" denotes a relatively flat, non-rotatable type digging implement used in relatively soft or dirt-like formations.

As further seen in FIG. 2, a keeper 26 of conventional design is used for removably affixing the cylindrical shank of a number of different digging implements within the prior art tooth receiving pocket 16.

The novel digging tooth 28 of the present invention has a forward ground engaging blade portion 30 which is made integrally with and extends from the cylindrical shank 32. The cylindrical shank 32 has characteristics associated with a prior art rock type bit which is usually rotatably received within the pocket 16. The improved dirt type tooth 28 has a rear end 34 which is reduced in diameter at 36 for receiving keeper 26 in captured relationship therewithin so that the improved tooth 28 can be removably affixed within bore 20 of the rock type bit pocket 16. A novel shield assembly 38 is made integral with the cutter blade 30 and shank 32, and rearwardly extends towards the rear end 34 and pocket 16.

Figure 3:
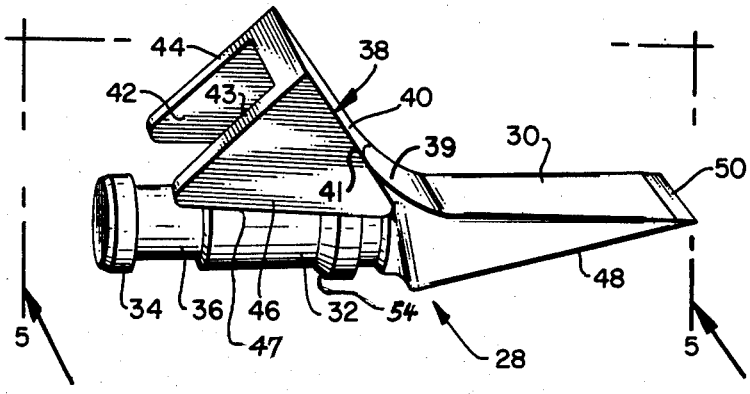
FIG. 3 is a side elevational view of the digging tooth disclosed in FIGS. 1 and 2.
Figure 4:
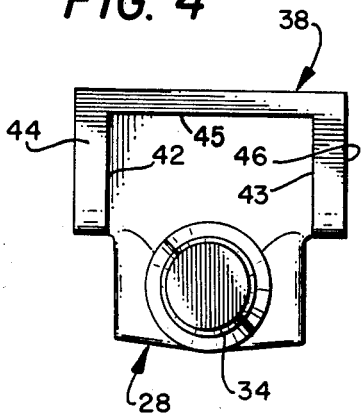
FIG. 4 is an end view of the digging tooth disclosed in FIG. 3.

As seen in FIG. 3, together with other figures of the drawings, the shield assembly 38 has a forward wall portion which upwardly curves at 39 from the upper face of the tooth blade, and continues as a divider wall at 40 where the divider wall 40 terminates at edge portion 41. The shield assembly includes spaced opposed side walls 42 and 43, each of which are attached at one edge portion thereof to the divider wall 40, and each of which rearwardly and downwardly extends therefrom. The opposed walls include sloped edge portions, one of which is illustrated at 44, and further include opposed outer faces, one of which is illustrated by numeral 46. Numeral 45 in FIG. 4 illustrates the inner wall surface which is opposed to the outer wall surface of the divider wall 40. Numeral 47 broadly indicates the lowermost edge portion of the opposed walls 42 and 43. Hence, the shield assembly 38 forms a cavity having a forward wall portion 45, connected to opposed wall surfaces 42 and 43. The wall surfaces jointly cooperate to form a cavity within which at least part of the tooth receiving pocket is received.

Numeral 48 indicates the lower face of the ground engaging cutter blade. The forward terminal end of the cutter blade is in the form of a sharp edge portion 50.

Figure 5:
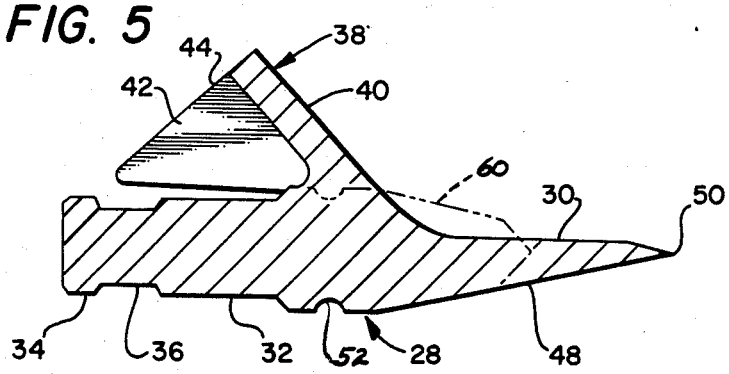
FIG. 5 is a cross-section view taken along line 5—5 of FIG. 3.

As shown in FIGS. 3 and 5, groove 52 is formed forwardly of a boss 54. The boss 54 abuttingly engages the outermost end 56 of bore 20 when shank 32 of the dirt type digging tooth 28 is received within cylindrical bore 20.

In operation, keeper 26 is forced into the reduced diameter or annular groove 36 of shank 32 of the dirt type digging tooth. The shank is then forced into bore 20 of pocket 16 until shoulder or boss 54 of the tooth shank abuttingly engages outermost end 56 of bore 20 of the pocket. At this time, keeper 26 is located slightly rearwardly of shoulder 24 of bore 20 so that the shank of the digging tooth is releasably captured within bore 20. As the digging tooth is mounted respective to the pocket, opposed inside wall surfaces 42 and 43 are received in abutting engagement respective to opposed outer sidewalls 18 and 18' of the pocket. Inner wall 45 of divider wall 40 abuttingly engages the adjacent outermost end of the pocket. Accordingly, as cutter blade 30 excavates material from a formation, the material is forced up curved portion 39 of divider wall 40 and into the digging buckets 14. Therefore, shield assembly 38 protects the external surfaces of the pocket which normally are subjected to considerable wear. The shield assembly is forced rearwardly towards the pocket by the digging action of the trencher machine and thereby reduces the likelihood of the digging teeth inadvertently being lost from the pocket. The opposed sidewalls 42 and 43 of the shield assembly abuttingly engage the opposed outer sidewalls 18 and 18' of the pocket whenever the digging action imparts rotational forces along the longitudinal axial centerline of the tooth shank.

The pocket 16 is usually welded at one of the wall surfaces, such as wall surface 58, for example, to the bucket lip, although the pocket can be welded or bolted to the bucket lip in any number of manners known to those skilled in the art.

The shield assembly forms a cavity into which the upper forward part of the pocket is received, while simultaneously the digging tooth shank is received within the complementary configured bore of the pocket.

In one specific example of the present invention, the buckets of a wheel type trenching machine 10 were provided with C10H pockets 16 manufactured by Kennametal, Inc., Bedford, Pa. 15522. The pockets were welded onto the bucket lip in a manner whereby edge portion 50 of the tooth cutter blade was substantially aligned with the curved lip of the bucket, for reasons appreciated by those skilled in the art. A shank 32 was removed from a carbide rock type bit marketed by Kennametal, Inc., Bedford, Pa. 15522. The rock bit is particularly shown on page 3, in Catalogue D80-43(10) LO, copyrighted 1980 by Kennametal, Inc. A cutter blade of a prior art paddle type digging tooth, such as a Corona 70 tooth manufactured by Tuf-Go, was removed and welded onto the forward end of the Kennametal shank. Next the shield was fabricated from $\frac{3}{8}$ inch plate metal by cutting and grinding the rectangular wall portion 40 and the triangular walls 42 and 43 which were subsequently welded together and to the cutter blade and shank. The dot-dash area 60 of FIG. 5 was removed while the curved area 39 was built up from welding and subsequently ground into a smooth transition between the flat surfaces 30 and 40. The distance between the interior of wall surfaces 42 and 43 was two inches while the outside measurement was two and three-fourths inches.

The resultant digging tooth coincided with the illustrations found in FIGS. 2–5 hereof. The resultant digging tooth shank was mounted within bore 20 of pocket 16 of FIG. 2. The tooth was driven into position by hammering on curved part 39 until shoulder 54 abuttingly engaged outermost end 56 of bore 20. The inner wall surfaces 42 and 43 were found to be slightly spaced from the exterior surfaces 18 and 18' of the pocket. The digging tooth resisted rotation whenever a rotational force was imparted thereinto.

The present invention provides a method and apparatus for rendering a dirt type digging tooth non-rotatable respective to a pocket designed for accepting rock type bits by the provision of a rearwardly extending shield assembly which forms a cavity within which at least part of the pocket is received so that the inner sidewalls of the shield assembly abuttingly engage the opposed outer sidewalls of the pocket and thereby resists rotation. Such a method enables a digging tooth having a dirt type digging element at one end thereof and a cylindrical type shank at the other end thereof to be non-rotatably mounted in a removable manner within a pocket made for receiving a rotatable type rock bit.

The resultant digging tooth is structurely sound, can be manufactured by forgoing, and greatly simplifies the task of changing from rotatable rock type bits to non-rotatable dirt type teeth.

I claim:

1. An improved non-rotatable, dirt type excavating tooth in combination with a support pocket having a cylindrical bore for receiving a rotatable type prior art bit;

said excavating tooth includes a cylindrical shank at the rear end thereof and a ground engaging blade at the forward end thereof, said shank being made complementary respective to the support pocket bore so that said shank can be telescopingly received in a captured manner within said bore of said pocket, thereby removably mounting said excavating tooth respective to the pocket;

said excavating tooth includes a relatively flat ground engaging blade at the forward end thereof; a shield assembly, means attaching said shield assembly at a medial portion defined by the area where the shank is joined to the blade;

said shield assembly includes a divider wall which upwardly and rearwardly extends respective to said medial portion, spaced sidewalls which extend from said medial portion and are attached to and extend downwardly and rearwardly from said divider wall and receive opposed external sides of the support pocket therewithin, the opposed external sides of the support pocket abuttingly engage the sidewalls and prevent axial rotation of said dirt type excavating tooth respective to a pocket for receiving a rotatable type bit.

2. The combination of claim 1 wherein said spaced sidewalls and said divider wall jointly provide a cavity within which at least part of a support pocket is received when said shank is mounted within the bore of the support pocket.

3. The combination of claim 1 wherein said spaced sidewalls of said shield assembly have inside wall surfaces which are parallel respective to the longitudinal axis of a pocket bore within which said shank may be received, said inside wall surfaces slidably engage opposed outer wall surfaces of the pocket when the tooth and pocket are assembled.

4. The combination of a non-rotatable dirt type excavating tooth and a support pocket therefor; said support pocket includes spaced outer wall surfaces, and a cylindrical bore for receiving a cylindrical shank of a prior art rotatable type bit;

said tooth includes a cylindrical shank at one end thereof made complementary respective to said pocket bore so that said shank can be telescopingly received in a captured manner within the bore of said support pocket, thereby removably mounting said excavating tooth respective to a pocket;

said tooth includes a blade-like ground engaging member at the other end thereof, and a shield assembly located at a medial portion thereof;

said shield assembly includes spaced sidewalls that extend from attached relationship respective to said medial portion and a divider wall that upwardly and rearwardly extends respective to said medial portion of the tooth; said spaced sidewalls of said shield assembly are attached to and extend downwardly and rearwardly from said divider wall so that said shield assembly can receive part of said support pocket therein, thereby abuttingly engaging the outer wall surfaces of said support pocket, and preventing axial rotation of said blade-like ground engaging member respective to said pocket.

5. The excavating tooth of claim 4 wherein said spaced sidewalls and said divider wall jointly provide a cavity within which at least part of said support pocket is received when said shank is mounted within said bore of the support pocket.

6. The excavating tooth of claim 4 wherein said spaced sidewalls of said shield assembly have inside wall surfaces which are parallel respective to the longitudinal axis of the pocket bore, said inside wall surfaces slidably engage said outer wall surfaces of the pocket when the tooth and pocket are assembled.

7. An improved non-rotatable, dirt type excavating tooth for use in a support pocket having a cylindrical bore therein for receiving a rotatable type prior art bit;

said excavating tooth includes a cylindrical shank at the rear end thereof and a ground engaging blade at the leading end thereof, said shank being made complementary respective to the support pocket bore so that said shank can be telescopingly received in a captured manner within the bore of a support pocket; thereby removably mounting said excavating tooth respective to a support pocket;

said excavating tooth includes a relatively flat ground engaging blade at the leading end thereof; a shield assembly, means attaching said shield assembly at a medial portion of the tooth defined by the area where the shank is joined to the blade;

said shield assembly includes a divider wall which separates said sidewalls, said divider wall and sidewalls jointly define a cavity within which at least part of a support pocket can be received when said shank is mounted within the bore of a support pocket;

said shield assembly includes spaced sidewalls which extend from said medial portion, said sidewalls have an inner surface adapted to abuttingly engage opposed external sides of a support pocket that said tooth may be mounted in, thereby preventing axial rotation of said dirt type excavating tooth respective to a support pocket for receiving a rotatable type bit.

8. The combination of claim 7 wherein said spaced sidewalls and said divider wall jointly provide a cavity within which at least part of a support pocket can be received when said shank is mounted within the bore of the support pocket.

9. An excavating machine, a support pocket having at least two external wall surfaces spaced from one another, means by which said pocket is mounted for movement respective to said excavating machine, a cylindrical bore formed in said support pocket within which the shank of a rotatable rock type bit is removably received, the combination with said support pocket of a non-rotatable dirt type excavating tooth;

said excavating tooth includes means forming a cylindrical shank at a rear end thereof and a ground engaging blade at a forward end thereof, said shank being made complementary respective to the support pocket bore so that said shank can be telescopingly received in a captured manner within the bore of said pocket, thereby removably mounting said excavating tooth respective to the pocket; said blade has a relatively flat ground engaging surface at a forward marginal end thereof; and is attached to said shank at the other end thereof; a shield assembly, said shield assembly includes a divider wall attached at a medial portion of the excavating tooth at a location defined by the area where the shank is joined to the blade;

said divider wall extends upwardly from said blade, said shield includes spaced sidewalls attached to opposed sides of said divider wall, said sidewalls and said divider wall have an inside surface which jointly define a cavity within which at least part of for support pocket is received when said shank is mounted within the bore of the support pocket, so that the inside surface of the shield abuttingly engages the opposed external sides of the support pocket thereby preventing axial rotation of said dirt type excavating tooth respective to a pocket for receiving a rotatable type bit.

10. The combination set forth in claim 9 wherein said divider wall upwardly and rearwardly extends from said blade and forms a curved surface which is a continuation of the ground engaging blade.

11. The combination of claim 9 wherein said spaced sidewalls of said shield assembly have inside wall surfaces which are parallel respective to the longitudinal axis of the pocket bore within which said shank may be received, said inside wall surfaces slidably engage the opposed outer wall surfaces of the pocket when the tooth and pocket are assembled.

12. In an excavating machine having a plurality of tooth receiving support pockets mounted for movement thereon to thereby provide for an excavation operation when digging teeth are mounted on the pockets, each support pocket includes spaced outer wall surfaces, and a cylindrical bore for receiving a cylindrical shank of a prior art rotatable type bit; the combination of said support pocket with a non-rotatable dirt type excavating tooth;

said excavating tooth includes a cylindrical shank at one end thereof made complementary respective to said pocket bore so that said shank can be telescopingly received in a captured manner within the bore of said support pocket, thereby removably mounting said excavating tooth respective to a pocket;

said tooth includes a blade-like ground engaging member at the other end thereof, and a shield assembly attached to a medial portion thereof;

said shield assembly includes a divider wall having a lower end attached to and forming part of said ground engaging member, said divider wall upwardly and rearwardly extends respective to said medial portion of the tooth; spaced sidewalls attached to and extending from said divider wall; said spaced sidewalls and said divider wall jointly provide a cavity within which at least part of said support pocket is received when said shank is mounted within the bore of the support pocket; thereby preventing axial rotation of said blade-like ground engaging member respective to said pocket.

13. The excavating tooth of claim 12 wherein said spaced sidewalls of said shield assembly have inside wall surfaces which are parallel respective to the longitudinal axis of the pocket bore, said inside wall surfaces slidably engage the outer wall surfaces of the pocket when the tooth and pocket are assembled.

* * * * *

UNITED STATES PATENT AND TRADEMARK OFFICE

CERTIFICATE OF CORRECTION

PATENT NO. : 4,611,417

DATED : September 16, 1986

INVENTOR(S) : JOHN H. CARLSON

It is certified that error appears in the above-identified patent and that said Letters Patent is hereby corrected as shown below:

Column 5, line 68, substitute --forging-- for "forgoing";

Column 8, line 11, substitute --the-- for "for".

Signed and Sealed this

Twenty-third Day of December, 1986

*Attest:*

DONALD J. QUIGG

*Attesting Officer* *Commissioner of Patents and Trademarks*